US008097560B2

(12) United States Patent
Matsunaga et al.

(10) Patent No.: US 8,097,560 B2
(45) Date of Patent: Jan. 17, 2012

(54) HEAT-SENSITIVE RECORDING MATERIAL

(75) Inventors: Yoshiaki Matsunaga, Numazu (JP); Yoshikazu Kaneko, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 956 days.

(21) Appl. No.: 12/043,770

(22) Filed: Mar. 6, 2008

(65) Prior Publication Data

US 2008/0220969 A1 Sep. 11, 2008

(30) Foreign Application Priority Data

Mar. 7, 2007 (JP) ..... 2007-056733

(51) Int. Cl.
*B41M 5/333* (2006.01)
*B41M 5/42* (2006.01)

(52) U.S. Cl. ..... 503/216; 503/225; 503/226

(58) Field of Classification Search ..... None
See application file for complete search history.

(56) References Cited

U.S. PATENT DOCUMENTS

| | | | | |
|---|---|---|---|---|
| 5,804,528 | A * | 9/1998 | Aoki et al. | 503/204 |
| 6,710,015 | B2 | 3/2004 | Kaneko et al. | |
| 6,846,619 | B2 | 1/2005 | Kaneko et al. | |
| 6,890,698 | B2 | 5/2005 | Naruse et al. | |
| 2004/0171487 | A1 | 9/2004 | Kajikawa et al. | |
| 2005/0137088 | A1 | 6/2005 | Hayakawa et al. | |
| 2007/0099130 | A1 | 5/2007 | Takahashi et al. | |
| 2007/0219094 | A1 | 9/2007 | Kurose et al. | |

FOREIGN PATENT DOCUMENTS

| | | | |
|---|---|---|---|
| CN | 1796151 | A | 7/2006 |
| CN | 1812887 | A | 8/2006 |
| EP | 1452334 | A2 | 9/2004 |
| EP | 1738919 | A1 | 1/2007 |
| JP | 61-246088 | | 11/1986 |
| JP | 62-225391 | | 10/1987 |
| JP | 63-61198 | | 11/1988 |
| JP | 2002-52842 | | 2/2002 |
| JP | 3699221 | | 7/2005 |
| JP | 2005-305812 | | 11/2005 |
| JP | 2006-69058 | | 3/2006 |
| JP | 2006-175673 | | 7/2006 |
| JP | 2007-15311 | | 1/2007 |
| JP | 2007-30371 | | 2/2007 |
| WO | WO2005/102726 | A1 | 11/2005 |

OTHER PUBLICATIONS

Jun. 13, 2008 search report in connection with a counterpart European patent application No. 08 102 362.
Aug. 14, 2009 Chinese official action (and English translation thereof) in connection with a counterpart Chinese patent application No. 200810082902.9.
Apr. 18, 2011 Japanese official action in connection with a counterpart Japanese patent application.

* cited by examiner

*Primary Examiner* — Bruce H Hess
(74) *Attorney, Agent, or Firm* — Cooper & Dunham LLP

(57) ABSTRACT

The present invention provides a heat-sensitive recording material with enhanced color developing sensitivity maintaining heat resistance and image storage stability characteristics such as plasticizer resistance and water resistance. The present invention provides a heat-sensitive recording material including at least a substrate and a heat-sensitive color developing layer containing a leuco dye and developers on the front surface of the substrate, wherein as the developers 4-hydroxy-4'-allyloxydiphenyl sulfone is used in combination with a first diphenyl compound represented by formula (1) and/or a second diphenyl compound represented by formula (2).

(1)

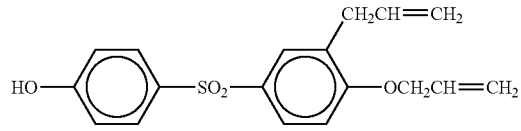

(2)

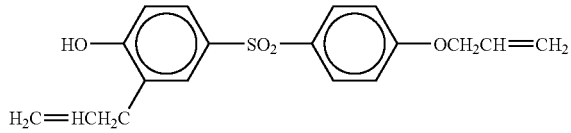

10 Claims, No Drawings

HEAT-SENSITIVE RECORDING MATERIAL

BACKGROUND

1. Technical Field

This disclosure relates to a heat-sensitive recording material used in the field of printers for such as computer outputs and calculators, recorders for medical measurements, low-speed and high-speed facsimiles, automatic ticket machines, and handy terminals.

2. Description of the Related Art

So far, various heat-sensitive recording materials have been proposed that have on a substrate a heat-sensitive color developing layer containing at least a leuco dye and a developer and utilize a color developing reaction between the leuco dye and the developer. Such heat-sensitive recording materials have advantages including (1) no need for subjecting them to a cumbersome treatment such as development and fixation and ability to record in a short time using a relatively simple apparatus, (2) less noise production, and (3) less costs. Such a heat-sensitive recording material is thus used for copying books and documents, for example, and used widely as a recording material for electron computers, facsimiles, ticketing devices, label printers, recorders, and handy terminals.

Heat-sensitive recording materials are desired to develop colors of high density promptly and to develop highly tough color images and backgrounds. In recent years, heat-sensitive recording materials are increasingly frequently used also in fields where reliability of recorded images is regarded as important, such as in labels, and are more and more desired to have high storage stability against plasticizers and oils and fats in organic polymer materials used in packages of the heat-sensitive recording material.

Furthermore in recent years, in order to conserve energy for a better environment or to make recording materials compatible with portable thermal printers, a technology is studied that is able to develop colors with a low printing energy input. Also in order to make recording materials compatible with high-speed printing using a high-speed printer, a technology to supersensitize a heat-sensitive paper is studied. However, since a heat-sensitive recording material is a compound to develop colors by heat, intensity of colors developed is enhanced depending on the heat applied. Thus, when a highly sensitive heat-sensitive recording material is left in summer in a room where the temperature is high, or when it is stuck as a heat-sensitive recording label and heated by a microwave oven, there has been a disadvantage that the background becomes black and it becomes difficult to read characters and bar-code (this phenomenon is called as 'background fog'). Thus for heat-sensitive recording materials, it is challenged to balance color developing sensitivity and heat resistance as much as possible.

As related arts, heat-sensitive recording materials using a 4-hydroxyphenyl-4'-alkoxyphenyl sulfone derivative are disclosed in Japanese Patent Application Laid-Open (JP-A) No. 62-225391 and Japanese Patent Application Publication (JP-B) No. 63-61198. Specific examples include 4-hydroxyphenyl-4'-octyloxyphenyl sulfone, 4-hydroxyphenyl-4'-dodecyloxyphenyl sulfone, 4-hydroxyphenyl-4'-benzyloxyphenyl sulfone, 4-hydroxyphenyl-4'-isopropoxyphenyl sulfone.

However, heat-sensitive recording materials in which these 4-hydroxyphenyl-4'-alkoxyphenyl sulfone derivatives are simply used in combination with leuco dyes, have disadvantages that they have insufficient color development and heat resistance storage stability at the image portion and the background portion.

It is one of technically widely used methods to combine these developers and a leuco dye of a high melting point and to add further a sensitizing agent to enhance heat resistance without reducing color developing sensitivity. However, a heat-sensitive recording material where these 4-hydroxyphenyl-4'-alkoxyphenyl sulfone derivatives and a leuco dye of a high melting point are combined and a sensitizing agent is further added, frequently exhibits other disadvantages. Therefore an effective sensitizing agent was not available so far. Examples of the disadvantages include background fog and discoloration of the image portion with time, which were limiting the usage of above heat-sensitive recording material using a combination of 4-hydroxyphenyl-4'-alkoxyphenyl sulfone derivatives and a leuco dye with addition of a sensitizing agent.

Also as related arts, a heat-sensitive recording material using 4-acetylbiphenyl is disclosed in JP-A No. 61-246088 and JP-A No. 10-138645, and the like. However, when 4-acetylbiphenyl is used as a sensitizing agent, a simple mere combination of 4-acetylbiphenyl and developers resulted in insufficient heat resistance storage stability of the image portion and the background portion at 80° C.

BRIEF SUMMARY

In an aspect of this disclosure, there is provided a heat-sensitive recording material with enhanced color developing sensitivity maintaining heat resistance and image storage stability characteristics such as plasticizer resistance and water resistance.

As a result of studies and investigations to obtain a heat-sensitive recording material with enhanced color developing sensitivity maintaining heat resistance and image storage stability, it was determined that 4-hydroxy-4'-allyloxydiphenyl sulfone can be used in combination with the compound represented by formula 1 and/or the compound represented by formula 2 as developers contained in a heat-sensitive color developing layer.

Various aspects and features can be included, such as, for example, the following.

(1) A heat-sensitive recording material composed of at least a substrate having a front surface and a back side and a heat-sensitive color developing layer containing a leuco dye and developers on the front surface of the substrate, wherein as developers 4-hydroxy-4'-allyloxydiphenyl sulfone is used in combination with a first diphenyl sulfone compound represented by formula (1).

(1)

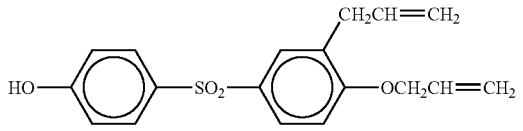

(2) A heat-sensitive recording material composed of at least a substrate having a front surface and a back side and a heat-sensitive color developing layer containing a leuco dye and developers on the front surface of a substrate, wherein as developers 4-hydroxy-4'-allyloxydiphenyl sulfone is used in combination with a second diphenyl sulfone compound represented by formula (2).

(2)

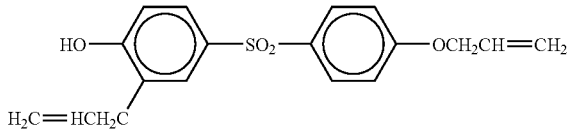

(3) The heat-sensitive recording material according to any one of items (1) and (2), wherein the amount of any one of the first diphenyl sulfone compound represented by formula (1) and the second diphenyl sulfone compound represented by formula (2) is 0.5 parts by mass to 3 parts by mass per 100 parts by mass of 4-hydroxy-4'-allyloxydiphenyl sulfone as to amounts of developers contained in the heat-sensitive color developing layer.

(4) A heat-sensitive recording material composed of at least a substrate having a front surface and a back side and a heat-sensitive color developing layer containing a leuco dye and developers on the front surface of a substrate, wherein as developers 4-hydroxy-4'-allyloxydiphenyl sulfone is used in combination with both of the first diphenyl sulfone compound represented by formula (1) and the second diphenyl sulfone compound represented by formula (2).

(5) The heat-sensitive recording material according to item (4), wherein the total amount of both of the first diphenyl sulfone compound represented by formula (1) and the second diphenyl compound represented by formula (2) is 0.5 parts by mass to 3 parts by mass per 100 parts by mass of 4-hydroxy-4'-allyloxydiphenyl sulfone as to amounts of developers contained in the heat-sensitive color developing layer.

(6) The heat-sensitive recording material according to any one of items (1) to (5), wherein an intermediate layer containing a thermoplastic hollow resin particle is placed between the substrate and the heat-sensitive color developing layer.

(7) The heat-sensitive recording material according to any one of items (1) to (6), wherein an over layer having a pigment and a water soluble resin is further placed on the heat-sensitive color developing layer.

(8) A heat-sensitive recording label, wherein an adhesive layer is placed on the back side of the heat-sensitive recording material according to any one of items (1) to (7).

(9) A peeling liner less heat-sensitive recording label equipped with a heat-sensitive adhesive layer that exhibits adhesive property by heat on the back side of the heat-sensitive recording material according to any one of items (1) to (7).

(10) A heat-sensitive recording magnetic sheet equipped with a magnetic recording layer on the back side of the heat-sensitive recording material according to any one of items (1) to (7).

DETAILED DESCRIPTION OF THE INVENTION

In the present invention, when 4-hydroxy-4'-allyloxydiphenyl sulfone is used as a developer contained in a heat-sensitive color developing layer and added by 100 parts by mass, (i) by adding 0.5 parts by mass to 3 parts by mass of a first compound represented by formula (1), (ii) by adding 0.5 parts by mass to 3 parts by mass of a second compound represented by formula (2), or (iii) by adding total 0.5 parts by mass to 3 parts by mass of both of the first compound and the second compound, a heat-sensitive recording material with enhanced color developing sensitivity maintaining heat resistance and image storage stability is provided.

When the added amount of developer per 100 parts by mass of the added amount of 4-hydroxy-4'-allyloxydiphenyl sulfone is less than 0.5 parts by mass, color developing sensitivity is not enhanced. When the added amount of developer per 100 parts by mass of 4-hydroxy-4'-allyloxydiphenyl sulfone is more than 3 parts by mass, though the color developing sensitivity is enhanced, the heat resistance is degraded.

Instead of 4-hydroxy-4'-allyloxydiphenyl sulfone used as a developer contained in the heat-sensitive color developing layer in the present invention, as required, 4-hydroxy-4'-allyloxydiphenyl sulfone combined with the other developer or auxiliary agent can be used. Also in such case, by adding 0.5 parts by mass to 3 parts by mass of the compounds represented by formulas (1) and (2), it is possible to enhance color developing sensitivity with heat resistance and image storage stability maintained in the heat-sensitive recording paper with the addition compared to a heat-sensitive recording paper without the addition.

An undercoat layer between a substrate and a heat-sensitive color developing layer (appropriately referred to as an 'under layer') and an overcoat layer on the heat-sensitive color developing layer (if it is proper, it is referred to as an 'over layer') may be placed. For materials forming the undercoat layer or the overcoat layer, binder resins, fillers and cross-linking agents used in the heat-sensitive color developing layer described above may be used. Usage of hollow resin particles as a filler in the undercoat layer makes it possible to enhance the sensitivity by its heat insulating properties.

<Under Layer>

A hollow particle used in the present invention is a particle having a shell of a thermopalastic resin and containing an air or other gas inside, that is a minute hollow particle already foamed. The average particle diameter of the hollow particles is preferably 0.4 μm to 10 μm, and more preferably 1.0 μm to 5.0 μm. The hollow particles having an average particle diameter (outer particle diameter) of less than 0.4 μm have a difficulty in production in which the hollow particles of a fixed hollow ratio are produced. When the average particle diameter is more than 10 μm, smoothness of the front surface after application and desiccation of the under layer is reduced, which results in a reduced closeness of the contact with a thermal head and in a degradation of enhancing effect on the sensitivity. Therefore, the hollow particles preferably have small variations in the particle distribution and a uniform distribution peak at the same time as they have an average particle diameter in the range described above. Furthermore, a minute hollow particle used in the present invention has preferably a hollow ratio of 30% or more, and further preferably a hollow ratio of 70% or more. The hollow ratio as used herein is a ratio of the inner diameter to the outer diameter of a hollow particle and expressed in the following equation.

$$\text{Hollow ratio}=(\text{inner diameter of hollow particle})/(\text{outer diameter of hollow particle})\times 100$$

The minute hollow particle used in the present invention has a shell of thermoplastic resin as was described above. Examples of the thermoplastic resins include polystyrene, polyvinyl chloride, polyvinylidene chloride, polyvinyl acetate, polyacrylic acid ester, polyacrylonitrile, polybutadiene, and copolymer resins thereof. Among them, the copolymer resins composed mainly of vinylidene chloride and acrylonitrile are particularly preferable.

By using the hollow particles as an under layer between the heat-sensitive color developing layer and the substrate, high heat insulating properties and enhanced closeness of the contact with a head are brought and color developing sensitivity is usually enhanced.

To provide an under layer on a substrate, the hollow particles described above are dispersed in water together with a binder such as a known water soluble polymer and an aqueous polymer emulsion, and the resultant dispersion is applied to the substrate front surface and dried. In this case, the amount of the hollow particle applied is at least 1 g per $m^2$ of the substrate, and preferably about 2 g per $m^2$ to 15 g per $m^2$ of the substrate. The amount of the binder resin applied may be such an amount that the under layer is strongly bonded to the substrate, and usually 2% by weight to 50% by weight of the total amount of the hollow particle and the binder resin.

In the present invention, a binder used when the under layer is formed is appropriately selected from the publicly known water soluble polymers and/or water soluble polymer emulsions. For specific examples thereof, examples of a binder contained in the heat-sensitive color developing layer described above may be applied, and particularly latexes such as styrene/butadiene copolymers or styrene/butadiene/acrylic-type copolymers are preferable. Examples of the water soluble polymers include polyvinyl alcohol, starches and derivatives thereof, derivatives of cellulose such as methoxy cellulose, hydroxyethyl cellulose, carboxymethyl cellulose, methyl cellulose and ethyl cellulose, sodium polyacrylate, polyvinylpyrrolidone, acrylamide/acrylic acid ester copolymers, acrylamide/acrylic acid ester/methacrylic acid ternaly copolymers, alkali salts of styrene/maleic acid anhydride copolymers, alkali salts of isobutylene/maleic acid anhydride copolymers, polyacrylamide, sodium alginate, gelatin and casein. Examples of the aqueous polymer emulsions include emulsions of latexes such as styrene/butadiene copolymers and styrene/butadiene/acrylic acid copolymers, or polyvinyl acetate resin, vinyl acetate/acrylic acid copolymers, styrene/acrylic acid ester copolymers, acrylic acid ester resins, polyurethane resins.

Furthermore, by combining the under layer with the present invention, enhancing effect on the color developing sensitivity by the under layer of the heat-sensitive recording material added with the developer of the present invention is high compared to that of the heat-sensitive recording material without an addition of the developer of the present invention.

<Heat-sensitive Color Developing Layer>

A heat-sensitive color developing layer contains at least a leuco dye, a developer and a binder resin, and further contains the other components as required.

—Leuco Dye—

The leuco dye is not particularly limited, can be appropriately selected from leuco dyes used in heat-sensitive recording materials depending on the purpose, and includes suitably for example leuco compounds of dyes of triphenylmethane series, fluoran series, phenothiazine series, auramine series, spiropyran series and indolinophthalide series.

Examples of the leuco dye include 3,3-bis (p-dimethylaminophenyl)-phthalide, 3,3-bis (p-dimethylaminophenyl)-6-dimethylaminophthalide (or crystal violet lactone), 3,3-bis (p-dimethylaminophenyl)-6-diethylaminophthalide, 3,3-bis (p-dimethylaminophenyl)-6-chlorphthalide, 3,3-bis (p-dibutylaminophenyl) phthalide, 3-cyclohexylamino-6-chlorfluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorfluoran, 3-(N-p-tolyl-N-ethylamino)-6-methyl-7-anilinofluoran, 2-{N-(3'-trifluormethylphenyl)amino}-6-diethylaminofluoran, 2-{3,6-bis(diethylamino)-9-(o-chloranilino) xanthylbenzoatelactam, 3-diethylamino-6-methyl-7-(m-trichloromethylanilino) fluoran, 3-diethylamino-7-(o-chloranilino) fluoran, 3-pyrrolidino-6-methyl-7-anilinofluoran, 3-di-n-butylamino-7-(o-chloranilino) fluoran, 3-N-methyl-N, n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino) fluoran, benzoylleucomethylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5' chlorphenyl) phthalide, 3-(2'-hydroxy-4'-dimethylaminophenyl)-3-(2'-methoxy-5'-nitrophenyl) phthalide, 3-(2'-hydroxy-4'-diethylaminophenyl)-3-(2'methoxy-5'-methylphenyl) phthalide, 3-(2'-methoxy-4'-dimethylaminophenyl)-3-(2'-hydroxy-4'-chlor-5'-meth ylphenyl) phthalide, 3-(N-ethyl-N-tetrahydrofurfuryl)amino-6-methyl-7-anilinofluoran, 3-N-ethyl-N-(2-ethoxypropyl) amino-6-methyl-7-anilinofluoran, 3-N-methyl-N-isobutyl-6-methyl-7-anilinofluoran, 3-morpholino-7-(N-propyl-trifluoromethylanilino) fluoran, 3-pyrrolidino-7-trifluoromethylanilinofluoran, 3-diethylamino-5-chloro-7-(N-benzyl-trifluoromethylanilino) fluoran, 3-pyrrolidino-7-(di-p-chlorphenyl)methylaminofluoran, 3-diethylamino-5-chlor-7-(α-phenylethylamino) fluoran, 3-(N-ethyl-p-toluidino)-7-(α-phenylethylamino) fluoran, 3-diethylamino-7-(o-methoxycarbonylphenylamino) fluoran, 3-diethylamino-5-methyl-7-(α-phenylethylamino) fluoran, 3-diethylamino-7-piperidinofluoran, 2-chloro-3-(N-methyl-toluidino)-7-(p-n-butylanilino) fluoran, 3-di-n-butylamino-6-methyl-7-anilinofluoran, 3,6-bis(dimethylamino) fluorenespiro(9,3')-6-dimethylaminophthalide, 3-(N-benzyl-N-cyclohexylamino) -5,6-benzo-7-α-naphthylamino-4'-bromofluoran, 3-diethylamino-6-chlor-7-anilinofluoran, 3-diethylamino-6-methyl-7-mesidino-4',5'-benzofluoran, 3-N-methyl-N-isopropyl-6-methyl-7-anilinofluoran, 3-N-ethyl-N-isoamyl-6-methyl-7-anilinofluoran, 3-diethylamino-6-methyl-7-(2',4'-dimethylanilino) fluoran, 3-morpholino-7-(N-propyl-trifluoromethylanilino) fluoran, 3-pyrrolidino-7-trifluoromethylanilinofluoran, 3-diethylamino-5-chloro-7-(N-benzyl-trifluoromethylanilino) fluoran, 3-pyrrolidino-7-(di-p-chlorphenyl)methylaminofluoran, 3-diethylamino-5-chlor-(α-phenylethylamino) fluoran, 3-(N-ethyl-p-toluidino)-7-(α-phenylethylamino) fluoran, 3-diethylamino-7-(o-methoxycarbonylphenylamino) fluoran, 3-diethylamino-5-methyl-7-(α-phenylethylamino) fluoran, 3-diethylamino-7-piperidinofluoran, 2-chloro-3-(N-methyltoluidino) -7-(p-N-butylanilino) fluoran, 3,6-bis (dimethylamino) fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chlor-7-anilinofluoran, 3-N-ethyl-N-(-2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzofluoran, 3-(p-dimethylaminophenyl)-3-{1,1-bis(p-dimethylaminophenyl) ethylene-2-yl}phthalide, 3-(p-dimethylaminophenyl)-3-{1,1-bis(p-dimethylaminophenyl)ethylene-2-yl}-6-dimethylaminophthalide, 3-(p-dimethylaminophenyl)-3-(1-p-dimethylaminophenyl-1-phenylethylene-2-yl) phthalide, 3-(p-dimethylaminophenyl) -3-(1-p-dimethylaminophenyl-1-p-chlorophenylethylene-2-yl) -6-dimethylaminophthalide, 3-(4'-dimethylamino-2'-methoxy) -3-(1'-p-dimethylaminophenyl-1'-p-chlorophenyl-1',3'-butadiene-4'-yl)benzophthalide, 3-(4'-dimethylamio-2'-benzyloxy)-3-(1'-p-dimethylaminophenyl-1'-phen yl-1',3'-butadiene-4'-yl) benzophthalide, 3-dimethylamino-6-dimethylamino-fluorene-9-spiro-3'-(6'-dimethylamino) phthalide, 3,3-bis(2-

(p-dimethylaminophenyl)-2-p-methoxyphenyl)ethenyl}-4,5,6,7-tetrachlorophthalide, 3-bis{1,1-bis(4-pyrrolidinophenyl)ethylene-2-yl}-5,6-dichloro-4,7-dibromophthalide, bis(p-dimethylaminostyryl)-1-naphthalenesulfonylmethane and bis(p-dimethylaminostyryl)-1-p-tolylsulfonylmethane. These may be used alone or in combination of two or more.

The amount of the developer is preferably 1 part by mass to 20 parts by mass per part by mass of the leuco dye, and more preferably 2 parts by mass to 10 parts by mass per part by mass of the leuco dye.

<Over Layer>

—Binder Resin—

Examples of the binder resin include polyvinyl alcohol resins such as polyvinyl alcohol, diacetone modified polyvinyl alcohols, carboxy modified polyvinyl alcohols, acetoacetyl modified polyvinyl alcohols, sulfonic acid modified polyvinyl alcohols and silicon modified polyvinyl alcohols; starches and derivatives thereof; derivatives of cellulose such as hydroxymethyl cellulose, hydroxyethyl cellulose, carboxymethyl cellulose, methyl cellulose and ethyl cellulose; water soluble polymers such as sodium polyacrylate, polyvinylpyrrolidone, acrylamide-acrylic acid ester copolymers, acrylamide-acrylic acid ester-methacrylic acid ternaly copolymers, alkali salts of styrene-maleic acid anhydride copolymers, alkali salts of isobutylene-maleic acid anhydride copolymers, polyacrylamide, sodium alginate, gelatin and casein; emulsions of polyvinyl acetate, polyurethane, polyacrylic acid, polyacrylic acid ester, vinyl chloride-vinyl acetate copolymers, polybutylmethacrylate and ethylene-vinyl acetate copolymers; latexes such as styrene-butadiene copolymers and styrene-butadiene-acrylic-type copolymers. The binder resins may be used alone or in combination of two or more.

—Cross-Linking Agent—

As cross-linking agents in the present invention, for example, polyamide epichlorohydrin-type cross-linking agents, hydrazide-type, oxazoline-type cross-linking agents, epoxy-type cross-linking agents, glyoxal cross-linking agent, carbodiimide cross-linking agent may be combined so far as the object of the present invention is not impaired.

Added amounts of the cross-linking agent in solution for applying the protective layer, which vary with modified amounts and types of functional groups of the cross-linking agent, is preferably 0.1 parts by mass to 20 parts by mass per 100 parts by mass of the binder resin, and more preferably 1 part by mass to 10 parts by mass.

—Filler—

For the filler, inorganic fine particles or organic fine particles are used. Examples of the inorganic fine particles include silicates such as silicon dioxide, calcium silicate, magnesium silicate, aluminum silicate, zinc silicate and amorphous silica; zinc oxide, aluminum oxide, titanium dioxide, aluminum hydroxide, barium sulfate, talc, clay, magnesium oxide, magnesium hydroxide, calcium carbonate and magnesium carbonate. Examples of the organic fine particle include nylon resin fillers, styrene/methacrylic acid copolymer fillers, polystyrene resin fillers, urea/formalin resin fillers and raw starch particles.

Added amounts of the filler in the solution for applying the protective layer, which varies with types of the filler, is preferably 50 parts by mass to 500 parts by mass per 100 parts by mass of the binder resin.

For the method of forming the protective layer, a method to apply solution for applying the protective layer on the heat-sensitive color developing layer is appropriate, details of which will be described below in Production of heat-sensitive recording material.

Deposition amount of the protective layer after desiccation is preferably 0.5 g/m$^2$ to 5.0 g/m$^2$, and more preferably 1.5 g/m$^2$ to 3.5 g/m$^2$.

<Heat-sensitive Recording Label>

A heat-sensitive recording label as the heat-sensitive recording material, in a first embodiment, contains an adhesive layer and a peeling liner on the surface of the adhesive layer on the back side of the substrate opposite to the side having a heat-sensitive color developing layer, and contains further the other components as required. On the back side, a back layer surface is also contained.

Materials for the adhesive layer are not particularly limited, can be appropriately selected depending on the purpose, and include for example urea resins, melamine resins, phenol resins, epoxy resins, vinyl acetate resins, vinyl acetate-acrylic copolymers, ethylene-vinyl acetate copolymers, acrylic resins, polyvinylether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubbers, cyanoacrylate resins and silicone resins. These may be used alone or in combination of two or more.

The heat-sensitive recording label contains, in a second embodiment, a heat-sensitive adhesive layer exhibiting adhesiveness by heat on the back side of the substrate opposite to the side having the heat-sensitive color developing layer, and contains further the other components as required. On the back side, a back layer surface is also contained.

The heat-sensitive adhesive layer contains a thermoplastic resin and a heat-fusing substance, and further contains a tackifier as required.

The thermoplastic resin provides cohesion and adhesive force. The heat-fusing substance is solid and does not give plasticity to the resin at normal temperature, however when it is heated it melts and give plasticity to the resin by swelling and softening it. The tackifier acts to enhance the adhesion.

Such heat-sensitive recording labels can be used as POS system labels and commodity distribution labels, has a wider application scope. In addition the heat-sensitive recording label without a peeling liner is environmentally excellent.

<Heat-sensitive Recording Magnetic Sheet>

A heat-sensitive recording magnetic sheet as the heat-sensitive recording material contains a magnetic recording layer on the back side of a substrate opposite to the side having the heat-sensitive color developing layer, and contains further the other components as required. On the back side, a back layer surface is also contained.

The magnetic recording layer can be formed on a substrate by coating using for example iron oxide, barium ferrite and vinyl chloride resin, urethane resin or nylon resin, or can be formed by such a method as vapor deposition and sputtering.

The magnetic recording layer is preferably placed on the side of the substrate opposite to the side having the heat-sensitive color developing layer, however it may be placed between the substrate and the heat-sensitive color developing layer or placed in a part of the heat-sensitive color developing layer.

Such heat-sensitive recording magnetic sheets can be used for tickets of railroads, new trunk routes and subways, and can be used in a wide spectrum of applications.

The heat-sensitive recording material of the present invention combines the particular developer, which enables to provide a heat-sensitive recording material with highly excellent color developing sensitivity maintaining discoloration resistance of the color developing images, that is, image storage stability characteristics such as plasticizer resistance and water resistance, and maintaining heat resistance.

EXAMPLES

Example 1

—Production of Heat-sensitive Recording Material—

(1) Preparation of Coating Solution of Under Layer

Coating solution of under layer was prepared by mixing the following ingredients, applied on a sheet of bond paper with a basis weight of 60 g/m$^2$ as a substrate so that the deposition amount after drying was 3.0 g/m$^2$, and dried to obtain a sheet of under layer-applied paper.

Non-foaming plastic minute hollow particles (the hollow ratio is 50%, the average particle diameter is 3 μm) . . . 60 parts by mass Styrene/butadiene copolymer latex (the solid content is 47.5%) . . . 30 parts by mass Water . . . 10 parts by mass (2) Preparation of Dye Dispersion (Solution A)

The following ingredients were dispersed by a sand mill until the average particle diameter was 0.5 μm, to prepare dye dispersion (solution A).

2-anilino-3-methyl-6-dibutylaminofluoran . . . 20 parts by mass

10% by mass aqueous solution of polyvinyl alcohol . . . 20 parts by mass

Water . . . 60 parts by mass (3) Preparation of Solution B

The following ingredients were dispersed by a ball mill until the average particle diameter was 1.5 μm, to prepare solution B.

Aluminum hydroxide filler . . . 20 parts by mass 4-hydroxy-4'-allyloxydiphenyl sulfone . . . 100 parts by mass Compound represented by formula (1) . . . 3 parts by mass 10% by mass aqueous solution of polyvinyl alcohol . . . 20 parts by mass Water . . . 40 parts by mass (4) Preparation of Solution C The following ingredients were dispersed by a ball mill, until the average particle diameter was 1.5 μm, to prepare solution C.

Aluminum hydroxide filler . . . 100 parts by mass

Aqueous solution of polyvinyl alcohol (the solid content is 10% by mass) . . . 20 parts by mass Water . . . 40 parts by mass (5) Preparation of Solution for Applying Heat-sensitive Color Developing Layer Solution for applying a heat-sensitive color developing layer was prepared by mixing the following ingredients, applied onto the undercoat layer, so that deposition amount of the dye contained in this solution was 0.5 g/m$^2$ after desiccation of this solution, and dried to form a heat-sensitive color developing layer.

Solution A . . . 20 parts by mass

Solution B . . . 60 parts by mass

Aqueous solution of diacetone modified polyvinyl alcohol (the solid content is 10% by mass) . . . 30 parts by mass Aqueous solution of dioctyl sulfosuccinic acid (the solid content is 5% by mass) . . . 1 part by mass (6) Preparation of Solution for Applying Protective Layer Solution for applying a protective layer was prepared by mixing the following ingredients, applied onto the color developing layer so that the dry deposition amount of this solution was 3.0 g/m$^2$, and dried to obtain a sheet of protective layer-applied paper.

Solution C . . . 60 parts by mass

Aqueous solution of diacetone modified polyvinyl alcohol (the degree of polymerization is 1,800, the degree of saponificaiton is 97.5%, the degree of modification is 4.0% by mol, and the solid content is 10% by mass) . . . 100 parts by mass Aqueous solution of adipic acid dihydrazide (the solid content is 10% by mass) . . . 10 parts by mass Aqueous solution of dioctyl sulfosuccinic acid (the solid content is 5% by mass) . . . 1 part by mass Subsequently the sheet of paper with under layer, heat-sensitive color developing layer and protective layer was treated by supercalender, stored for two days in a thermostatic bath at 40° C. to produce the heat-sensitive recording material of Example 1.

Example 2

—Production of Heat-sensitive Recording Material—

A heat-sensitive recording material of Example 2 was produced in the same manner as in Example 1 except that an added amount of the diphenyl sulfone compound represented by formula (1) was changed from 3 parts by mass to 0.5 parts by mass.

Example 3

—Production of Heat-sensitive Recording Material—

A heat-sensitive recording material of Example 3 was produced in the same manner as in Example 1 except that instead of adding 3 parts by mass of the diphenyl sulfone compound represented by formula (1) 3 parts by mass of the diphenyl sulfone compound represented by formula (2) was added.

Example 4

—Production of Heat-sensitive Recording Material—

A heat-sensitive recording material of Example 4 was produced in the same manner as in Example 1 except that instead of adding 3 parts by mass of the diphenyl sulfone compound represented by formula (1) 0.5 parts by mass of the diphenyl sulfone compound represented by formula (2) was added.

Example 5

—Production of Heat-sensitive Recording Material—

A heat-sensitive recording material of Example 5 was produced in the same manner as in Example 1 except that instead of adding 3 parts by mass of the diphenyl sulfone compound represented by formula (1) a combination of 1.5 parts by mass of the diphenyl sulfone compound represented by formula (1) and 1.5 parts by mass of the diphenyl sulfone compound represented by formula (2) was added.

Example 6

—Production of Heat-sensitive Recording Material—

A heat-sensitive recording material of Example 6 was produced in the same manner as in Example 1 except that instead of adding 3 parts by mass of the diphenyl sulfone compound represented by formula (1) a combination of 0.25 parts by mass of the diphenyl sulfone compound represented by formula (1) and 0.25 parts by mass of the diphenyl sulfone compound represented by formula (2) was added.

Example 7

—Production of Heat-sensitive Recording Material—

A heat-sensitive recording material of Example 7 was produced in the same manner as in Example 1 except that a hollow ratio of the non-foaming plastic minute hollow particles of the under layer was changed from 50% to 90%.

Example 8

—Production of Heat-sensitive Recording Material—

A heat-sensitive recording material of Example 8 was produced in the same manner as in Example 3 except that a hollow ratio of the non-foaming plastic minute hollow particles of the under layer was changed from 50% to 90%.

Example 9

—Production of Heat-sensitive Recording Material—

A heat-sensitive recording material of Example 9 was produced in the same manner as in Example 5 except that a hollow ratio of the non-foaming plastic minute hollow particle of the under layer was changed from 50% to 90%.

Comparative Example 3 of Production of Heat-sensitive Recording Material

A heat-sensitive recording material of Comparative Example 3 was produced in the same manner as in Example 1 except that an added amount of the diphenyl sulfone compound represented by formula (1) was changed from 3 parts by mass to 4 parts by mass.

Comparative Example 4 of Production of Heat-sensitive Recording Material

A heat-sensitive recording material of Comparative Example 4 was produced in the same manner as in Example 1 except that instead of adding 3 parts by mass of the diphenyl sulfone compound represented by formula (1) 4 parts by mass of the diphenyl sulfone compound represented by formula (2) was added.

Comparative Example 5 of Production of Heat-sensitive Recording Material

A heat-sensitive recording material of Comparative Example 5 was produced in the same manner as in Example 1 except that instead of adding 3 parts by mass of the diphenyl sulfone compound represented by formula (1) a combination of 2 parts by mass of the diphenyl sulfone compound represented by formula (1) and 2 parts by mass of the diphenyl sulfone compound represented by formula (2) was added.

Comparative Example 1

—Production of Heat-sensitive Recording Material—

A heat-sensitive recording material of Comparative example 1 was produced in the same manner as in Example 1 except that the diphenyl sulfone compound represented by formula (1) was not added.

Comparative Example 2

—Production of Heat-sensitive Recording Material—

A heat-sensitive recording material of Comparative example 2 was produced in the same manner as in Example 1 except that the diphenyl sulfone compound represented by formula (1) was not added and a hollow ratio of the non-foaming plastic minute hollow particles of the under layer was changed from 50% to 90%.

TABLE 1

| | Diphenyl sulfone compound added to developer | Added amount of diphenyl compound (parts by mass) | Hollow ratio of thermoplastic hollow resin particle of the undrer layer (%) |
|---|---|---|---|
| Example 1 | (1) | 3 | 50 |
| Example 2 | (1) | 0.5 | 50 |
| Example 3 | (2) | 3 | 50 |
| Example 4 | (2) | 0.5 | 50 |
| Example 5 | (1)/(2) | 1.5/1.5 | 50 |
| Example 6 | (1)/(2) | 0.25/0.25 | 50 |
| Example 7 | (1) | 3 | 90 |
| Example 8 | (2) | 3 | 90 |
| Example 9 | (1)/(2) | 1.5/1.5 | 90 |
| Comparative Example 3 | (1) | 4 | 50 |
| Comparative Example 4 | (2) | 4 | 50 |
| Comparative Example 5 | (1)/(2) | 2/2 | 50 |
| Comparative Example 1 | Not added | — | 50 |
| Comparative Example 2 | Not added | — | 90 |

Next, the following properties were measured as follows with respect to each protective layer applied paper thus obtained. The result is shown in Table 2.

<(1) Color Developing Sensitivity>

On sheets of the protective layer applied paper that have been subjected to a calender treatment, images were printed by a heat-sensitive image printing experimental device having a thin-film head manufactured by Matsushita Electronic Components Co., Ltd. under conditions of a head power of 0.45 W/dot, a one-line recording time of 20 msec/L, and a scanning density of 8×385 dot/mm, with a pulse width from 0.0 mmsec to 0.7 mmsec for every 1 msec, and the image density was measured by Macbeth densitometer RD-914 to calculate a pulse width where the density becomes 1.0.

Sensitivity ratio was calculated using the pulse width measured in Comparative example 1 as a standard as follows:

(Pulse width of Comparative example 1)/(Pulse width of a sample measured)=Sensitivity Ratio The larger the value of sensitivity ratio, the more sensitive (heat responsive) the heat-sensitive recording material is.

<(2) Plasticizer Resistance>

Images were printed on the front surface of a test heat-sensitive recording material using a Printing simulator (manufactured by OHKURA ELECTRIC CO., LTD.) for heat-sensitive recording materials at an energy of 1.00 ms, a vinyl chloride wrap containing a plasticizer was stuck on the front surface, and the printed test heat-sensitive recording material with the wrap was left for 24 hours at 40° C., then the density of the image portions was measured by Macbeth densitometer RD-914.

<(3) Water Resistance>

Images were printed on the front surface of a test heat-sensitive recording material using a Printing simulator (manufactured by OHKURA ELECTRIC CO., LTD.) for heat-sensitive recording materials at an energy of 1.00 ms, the test heat-sensitive recording material after printing was immersed in a 100 mL water at 20° C. for 24 hr., then the density of the image portions after immersion was measured by Macbeth densitometer RD-914.

<(4) Heat Resistance>

Images were printed on a front surface of a test heat-sensitive recording material using Printing Simulator (manufactured by OHKURA ELECTRIC CO., LTD.) for heat-sensitive recording materials at an energy of 1.00 ms, the test heat-sensitive recording material after printing was left for 24 hours at 80° C., then the density of the background portions was measured by Macbeth densitometer RD-914.

TABLE 2

| | No | | | |
|---|---|---|---|---|
| Item | (1) Sensitivity ratio | (2) Plasticizer resistance | (3) Water resistance | (4) Heat resistance |
| Example 1 | 1.03 | 1.30 | 1.27 | 0.09 |
| Example 2 | 1.02 | 1.31 | 1.28 | 0.10 |
| Example 3 | 1.02 | 1.30 | 1.28 | 0.09 |
| Example 4 | 1.02 | 1.31 | 1.27 | 0.09 |
| Example 5 | 1.03 | 1.29 | 1.27 | 0.10 |
| Example 6 | 1.02 | 1.30 | 1.27 | 0.09 |
| Example 7 | 1.21 | 1.30 | 1.28 | 0.10 |
| Example 8 | 1.20 | 1.31 | 1.26 | 0.09 |
| Example 9 | 1.21 | 1.30 | 1.27 | 0.09 |
| Comparative Example 3 | 1.03 | 1.31 | 1.27 | 0.13 |
| Comparative Example 4 | 1.03 | 1.30 | 1.27 | 0.14 |
| Comparative Example 5 | 1.03 | 1.30 | 1.28 | 0.13 |
| Comparative Example 1 | 1.00 | 1.30 | 1.27 | 0.10 |
| Comparative Example 2 | 1.15 | 1.30 | 1.26 | 0.09 |

The heat-sensitive recording material of the present invention combines a particular developer, which enables to provide a heat-sensitive recording material with highly excellent color developing sensitivity maintaining discoloration resistance of the color developing images, that is, image storage stability characteristics such as plasticizer resistance and water resistance, and maintaining heat resistance, as is shown clearly in Table 2.

What is claimed is:

1. A heat-sensitive recording material, comprising:

a substrate having a front surface and a back side, a heat-sensitive color developing layer containing a leuco dye and developers on the front surface of the substrate, wherein as the developers 4-hydroxy-4'-allyloxydiphenyl sulfone is used in combination with any one of a first diphenyl sulfone compound represented by formula (1), a second diphenyl sulfone compound represented by formula (2), and both of the first diphenyl sulfone compound and the second diphenyl sulfone compound (1)

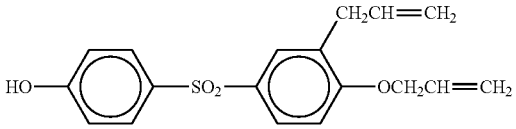

-continued (2)

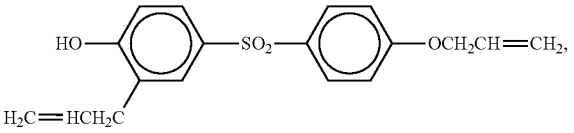

and wherein the total amount of the first diphenyl sulfone compound represented by formula (1) and the second diphenyl sulfone compound represented by formula (2) is 0.5 parts by mass to 3 parts by mass per 100 parts by mass of 4-hydroxy-4'-allyloxydiphenyl sulfone as to amounts of developers contained in the heat-sensitive color developing layer.

2. The heat-sensitive recording material according to claim 1, wherein the total amount of both of the first diphenyl sulfone compound represented by formula (1) and the second diphenyl sulfone compound represented by formula (2) is 0.5 parts by mass to 3 parts by mass per 100 parts by mass of 4-hydroxy-4'-allyloxydiphenyl sulfone as to amounts of developers contained in the heat-sensitive color developing layer.

3. The heat-sensitive recording material according to claim 1, wherein an intermediate layer containing thermoplastic hollow resin particles is provided between the substrate and the heat-sensitive color developing layer.

4. The heat-sensitive recording material according to claim 1, wherein an over layer comprising a pigment and a water soluble resin is further provided on the heat-sensitive color developing layer.

5. A heat-sensitive recording label, comprising a substrate having a front surface and a back side, a heat-sensitive color developing layer containing a leuco dye and developers on the front surface of the substrate, and an adhesive layer provided on the back side of the substrate, wherein as the developers 4-hydroxy-4'-allyloxydiphenyl sulfone is used in combination with any one of a first diphenyl sulfone compound represented by formula (1), a second diphenyl sulfone compound represented by formula (2), and both of the first diphenyl sulfone compound and the second diphenyl sulfone compound (1)

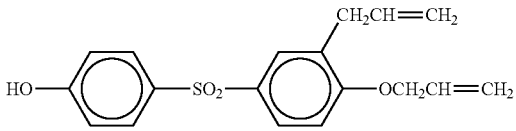

(2)

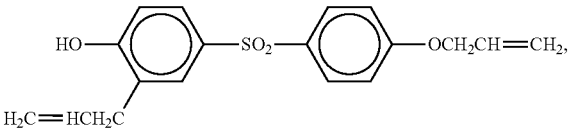

and wherein the total amount of the first diphenyl sulfone compound represented by formula (1) and the second diphenyl sulfone compound represented by formula (2) is 0.5 parts by mass to 3 parts by mass per 100 parts by mass of 4-hydroxy-4'-allyloxydiphenyl sulfone as to amounts of developers contained in the heat-sensitive color developing layer.

6. The heat-sensitive recording label according to claim 5, wherein the adhesive layer is a heat-sensitive adhesive layer, which exhibits adhesiveness by heat.

7. A heat-sensitive recording magnetic sheet, comprising:

a substrate having a front surface and a back side, a heat-sensitive color developing layer containing a leuco dye and developers on the front surface of the substrate, a magnetic recording layer on the back side of the substrate, wherein as the developers 4-hydroxy-4'-allyloxydiphenyl sulfone is used in combination with any one of a first diphenyl sulfone compound represented by formula (1), a second diphenyl sulfone compound represented by formula (2), and both of the first diphenyl sulfone compound and the second diphenyl sulfone compound (1)

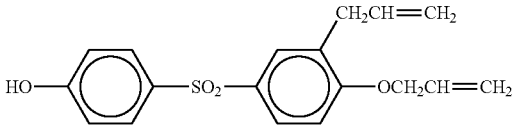

-continued (2)

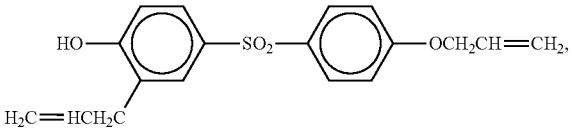

and wherein the total amount of the first diphenyl sulfone compound represented by formula (1) and the second diphenyl sulfone compound represented by formula (2) is 0.5 parts by mass to 3 parts by mass per 100 parts by mass of 4-hydroxy-4'-allyloxydiphenyl sulfone as to amounts of developers contained in the heat-sensitive color developing layer.

8. The heat-sensitive recording material according to claim 1, wherein the heat-sensitive color developing layer is formed utilizing an aqueous solution of diacetone modified polyvinyl alcohol mixed with said developers.

9. The heat-sensitive recording label according to claim 5, wherein the heat-sensitive color developing layer is formed utilizing an aqueous solution of diacetone modified polyvinyl alcohol mixed with said developers.

10. The heat-sensitive recording magnetic sheet according to claim 7, wherein the heat-sensitive color developing layer is formed utilizing an aqueous solution of diacetone modified polyvinyl alcohol mixed with said developers.

* * * * *